US006986164B1

(12) United States Patent
Morales

(10) Patent No.: US 6,986,164 B1
(45) **Date of Patent: *Jan. 17, 2006**

(54) TACTICAL SHIRT FOR CARRYING A CONCEALED WEAPON

(75) Inventor: Francisco J. Morales, Modesto, CA (US)

(73) Assignee: 5.11 Inc., Modesto, CA (US)

( * ) Notice: Subject to any disclaimer, the term of this patent is extended or adjusted under 35 U.S.C. 154(b) by 210 days.

This patent is subject to a terminal disclaimer.

(21) Appl. No.: 10/625,504

(22) Filed: Jul. 22, 2003

Related U.S. Application Data

(63) Continuation-in-part of application No. 10/455,130, filed on Jun. 6, 2003.

(51) Int. Cl.
*A41D 3/02* (2006.01)

(52) U.S. Cl. ..... 2/94; 2/250; 2/102; 224/911

(58) Field of Classification Search ..... 2/93, 2/94, 102, 108, 69, 85, 247–252, 2.5, 115; 224/911, 901.6, 196, 901.8, 198, 238, 192, 224/912

See application file for complete search history.

(56) References Cited

U.S. PATENT DOCUMENTS

| | | | | |
|---|---|---|---|---|
| 2,476,665 A | | 7/1949 | Jones | |
| 2,919,443 A | | 1/1960 | Kashiyama | |
| 4,106,121 A | | 8/1978 | Belson | |
| 4,262,832 A | | 4/1981 | Perkins | |
| 4,545,079 A | | 10/1985 | Bakken | |
| 4,882,786 A | | 11/1989 | Gross | |
| 4,998,654 A | | 3/1991 | Bruzek et al. | |
| 5,170,919 A | * | 12/1992 | DeSantis et al. | 224/587 |
| 5,278,998 A | * | 1/1994 | Book | 2/102 |
| 5,431,318 A | * | 7/1995 | Garcia | 224/192 |
| 5,689,829 A | * | 11/1997 | Rose | 2/77 |
| 5,692,237 A | * | 12/1997 | Bennett | 2/93 |
| 5,845,336 A | | 12/1998 | Golde | |
| 5,894,976 A | | 4/1999 | Harper | |
| D414,014 S | | 9/1999 | Blankenship, Jr. | |
| 6,131,198 A | * | 10/2000 | Westrick | 2/102 |
| 6,324,697 B1 | | 12/2001 | Shofner | |
| 6,760,922 B1 | * | 7/2004 | Morales | 2/94 |
| 2002/0189000 A1 | | 12/2002 | Jordan | |

OTHER PUBLICATIONS

Drawing of Expedition shirt, Royal Robbins.

* cited by examiner

*Primary Examiner*—Tejash Patel
(74) *Attorney, Agent, or Firm*—Thomas M. Freiburger

(57) ABSTRACT

A tactical shirt helps reduce the weight and bulk of items normally carried on a police officer's duty belt. A hidden front pocket extends essentially from the shirt's placket to the side seam of the shirt, providing a large cavity with an ample vertical opening line that is very conveniently used for a handgun, baton, handcuffs, mace, knife and/or spare magazines. No seam that would reveal the hidden pocket is readily visible, and the pocket's opening seam extends above and below the pocket opening and appears as a design feature of the shirt. With a fabric weight of at least about five ounces per square yard, a considerable weight and bulk of weapons can be hidden in the pocket without being noticeable to others.

28 Claims, 4 Drawing Sheets

TACTICAL SHIRT FOR CARRYING A CONCEALED WEAPON

This application is a continuation in part of application Ser. No. 10/455,130, filed Jun. 6, 2003.

BACKGROUND OF THE INVENTION

The invention relates to tactical garments for police work and in particular to a shirt with a pocket for containing and allowing efficient retrieval of a concealed weapon, especially a handgun.

Garments worn by police and having flaps, pockets and other devices for containing and concealing a weapon are known. See, for example, U.S. Pat. Nos. 6,131,198, 5,845,336, 5,692,237, 5,689,829, 4,882,786 and 4,545,079. Previous such garments, however, have failed to provide for rapid retrieval of a weapon, particularly a handgun, through use of a comfortable and natural movement and preferably requiring only one hand, in a casual shirt which appears as a normal button-front shirt of linen, cotton, khaki, etc.

The assignee of this invention has previously marketed a prior art shirt called the Expedition shirt. That shirt had a pocket in a location generally similar to that of the invention, but with a smaller cavity and with seams which were differently-located and more apparent. The pocket opened in a different manner, and in addition, the fabric of the Expedition shirt had a weight of only about 3.5 ounces per square yard, inadequate for the tactical purposes of the shirt described below.

SUMMARY OF THE INVENTION

The invention disclosed herein helps reduce the weight and bulk of items carried on an officer's duty belt. With a hidden front pocket that extends essentially from the shirt's placket to the side seam, the shirt provides a large cavity with an ample vertical opening line that is very conveniently used for a handgun, a telescoping baton, handcuffs, mace, a knife or spare magazines. No seam that would reveal the hidden pocket is readily visible. All of the items listed above are referred to herein as "weapons".

The lateral depth of the tactical shirt pocket enables a weapon such as a handgun to be inserted into the region below the armpit where one typical form of concealed handgun holster is designed to hold a gun. In this location it is comfortable and invisible, held alongside the rib cage, and is readily retrievable. A right hander keeps the weapon in the left hidden pocket, while a left hander keeps it in the right-side pocket.

The extra panel forming the hidden pocket preferably supports an outer, exposed pocket which may have a flap closure, and these pockets preferably are provided on both sides of the shirt in the chest area. The hidden panel forming the pocket is substantially disguised because its lateral depth preferably is limited by the side seam of the shirt, under the armpit, and by the seam at the sleeve attachment, while the upper boundary of the pocket preferably comprises the shoulder seam at or near the top of the shirt. At the bottom of the hidden pocket panel, the seam may be visible but is relatively low, approximately at the bottom of the ribs or within about an inch either way. The vertical seam where this hidden pocket opens, although visible, is very near the edge of the placket, preferably a parallel line within an inch of the pocket edge (about one-half inch in a preferred embodiment), and thus the seam line tends not to be noticed. The seam line, which extends higher than and lower than the pocket opening itself, tends to appear as a design feature of the shirt, not a flap for a hidden pocket.

The weight of the tactical shirt of the invention is important in serving the purposes of the invention. The shirt's fabric is preferably woven rather than knitted, and it must be of a weight sufficient that the shirt fabric will stand up to a relatively heavy load of items in the hidden pocket without stretching or significantly bulging. In the Expedition shirt mentioned above, the fabric weight was about 3.5 ounces per square yard. Such weight is insufficient for the purposes of the invention, and it is preferred that the tactical shirt have a fabric weight of at least about 5 ounces, more preferably at least 5.5 ounces. In one preferred embodiment the shirt has a weight in a range of about 5.8 to about 6.5 ounces.

Another important feature of the tactical shirt is the manner in which the hidden pocket or pockets open. As noted above, the opening line is along a seam only about one-half inch or so away from the edge of the button placket. This seam line extends from up and under the collar down to where the horizontal seam is located, approximately at the bottom of the ribs as noted above. The pocket opening may be about 7 to 9 inches in length. Importantly, the closure for the pocket opening is made such that a wearer can quickly insert a hand to wedge open the pocket and retrieve a weapon. For this purpose, separate strips of Velcro preferably are used to close the pocket, e.g. about 2 to 2.5 inches of Velcro at the top of the opening area and about 2 to 2.5 inches of Velcro at the bottom area, with a middle gap of about 2 inches to 3 inches in height, preferably about 2.5 inches. The Velcro strips when engaged hold the pocket flap closely against the underlying shirt fabric, appearing from a distance as a part of a seam of the shirt, rather than a pocket opening. This includes the middle portion of the pocket opening, devoid of Velcro or any other closure devices. The fabric edge at this pocket opening, as well as above and along below the seam, is doubled over and stitched, appearing as a reinforced seam somewhat similar to the edge of the placket.

When the user needs quick access to the handgun, mace or other weapon in the pocket, he simply jams a hand into the non-fastened region of the pocket opening, using the fingers to wedge open the pocket and spread and disengage the Velcro. If desired, one or two fingers from the other hand can be used to rip open the pocket prior to insertion of the weapon hand, but this is generally not necessary.

It is therefore among the objects of the invention to greatly improve tactical clothing, particularly for police officers, with a preferably button-front shirt having one or two hidden pockets which are readily accessible and which will conceal and carry a weapon in the comfortable area under the armpit, alongside the ribs. The pocket has seams which are not readily visible and has a closure that appears as a seam feature of the shirt, and which can be quickly opened with one hand, if desired, to retrieve a weapon when needed. Several relatively heavy weapons or other items can be carried concealed in the pocket, removing some of the weight from the officer's duty belt. These and other objects, advantages and features of the invention will be apparent from the following description of preferred embodiments, considered along with the drawings.

DESCRIPTION OF PREFERRED EMBODIMENTS

Figure 1:
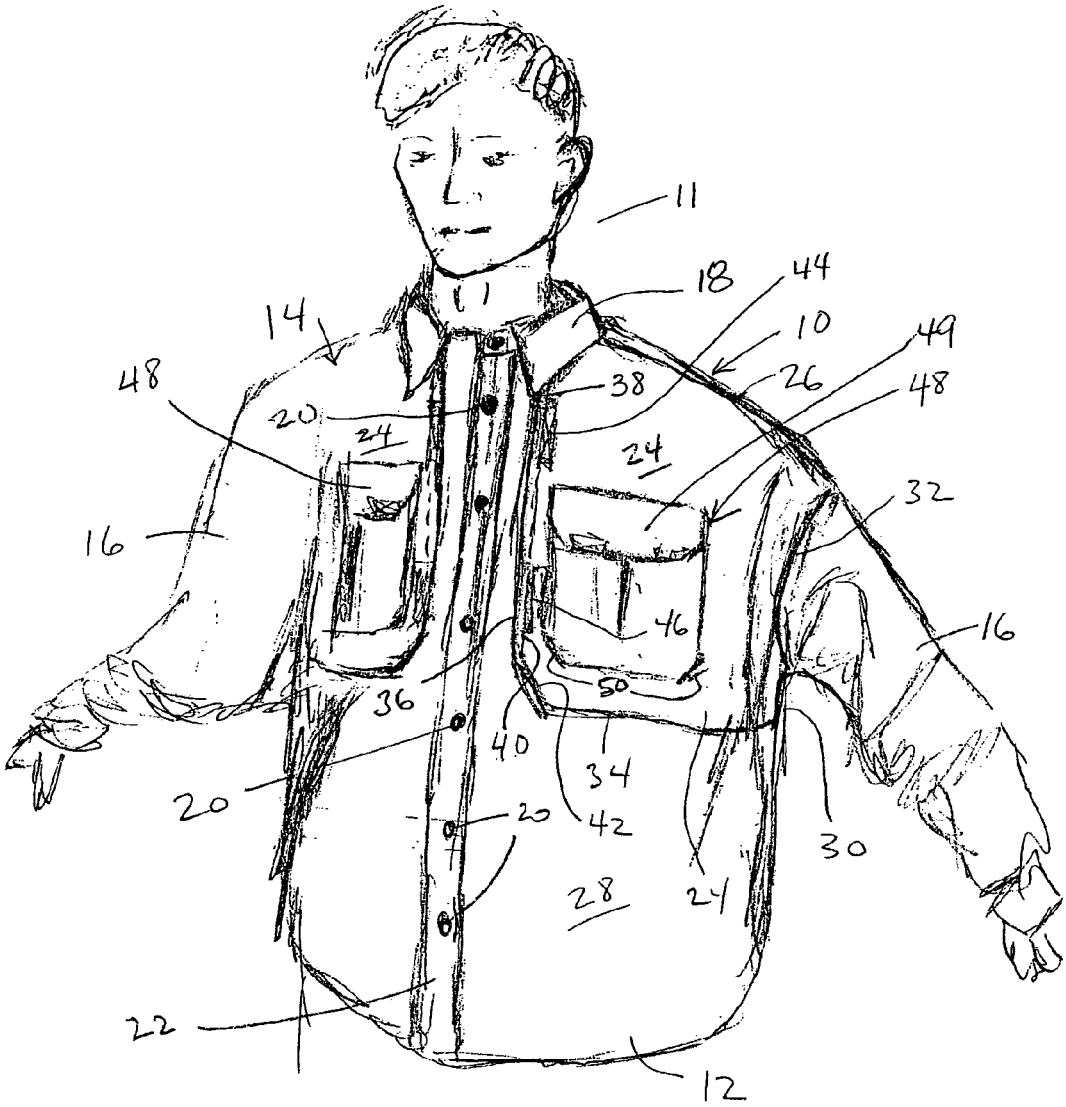
FIG. 1 is a frontal perspective view showing a person wearing a tactical shirt according to the invention.

In the drawings, FIG. 1 shows a tactical shirt 10 of the invention as worn by a person 11. The entire shirt is shown, including the shirt tail 12, which would normally be tucked into the pants of the person's waist.

As shown in the drawing, the shirt 10 comprises a fabric shell 14 generally in the shape of a sleeved shirt, in this case with long sleeves 16. The shirt includes a collar 18, and the shirt, woven rather than knitted, has a button-front with buttons 20 generally centered on a placket 22. The shirt includes an outer panel 24 which lies over the fabric shell 14 and is secured there too at a plurality of seams. The seams, in a preferred embodiment, include an upper seam 26 at the shoulder, approximately at the zenith of the shirt or slightly below, this seem being integral with the seam between the front and back panels of the fabric shell (front panel shown at 28). Another seam at which the panel 24 is attached is in a seam 30 integral with the seam attaching the front and back shirt panels; a seam 32 for a sleeve 16 where it attaches to the main body of the fabric shell 14, again with a common seam so that the panel 24 is less noticeable. At the bottom of the panel 24 is a bottom seam 34, and this seam is at a level approximately at the bottom of the user's rib cage or within about an inch or so above or below. This seam 34 is generally about 3 to 5 inches above the user's belt.

The panel 24 forms a hidden pocket, with a pocket opening line at a seam 36 closely adjacent to the edge of the shirt's placket 22. The pocket opening itself is defined approximately between points 38 and 40, with the seam line 36 extending along this pocket edge and also above and below the pocket. As shown, this seam line 36 preferably extends from a position up under the collar 18 down to beyond the point 40, to meet the bottom seam line 34. In a preferred embodiment there is included an angled or beveled corner 42, as shown, the length of this bevel being about 2 to 2½ inches. Only in the vertical slit between the upper and lower points 38 and 40 does the pocket open, and when the pocket is closed, the appearance is of one continuous seam down this edge 36 of the panel 24. Closure of the pocket is effected by hook/loop fasteners (Velcro), patches of which are indicated at 44 and 46 in FIG. 1, although only the stitching for securing these hook/loop fasteners is actually visible from the front of the shirt, the fasteners being located between the panel 24 and the fabric shell 14 beneath. From a few feet away the existence of these Velcro patches is not apparent at all.

FIG. 1 also shows that exposed, visible outer pockets 48 preferably are also included, secured to the outer side of the fabric panels 24. These pockets can depleted, as shown, and can include top enclosure flaps 49. At the bottom edges of these pockets are, in a preferred form of the shirt, angled or beveled edges 50 the inner one of which is substantially parallel to the beveled corner 42 of the underlining panel, thus complementing the appearance of the panel corner 42 and helping disguise the purpose of the panel seams 36 and 34, making them appear as part of a design feature for the shirt.

Figure 2:
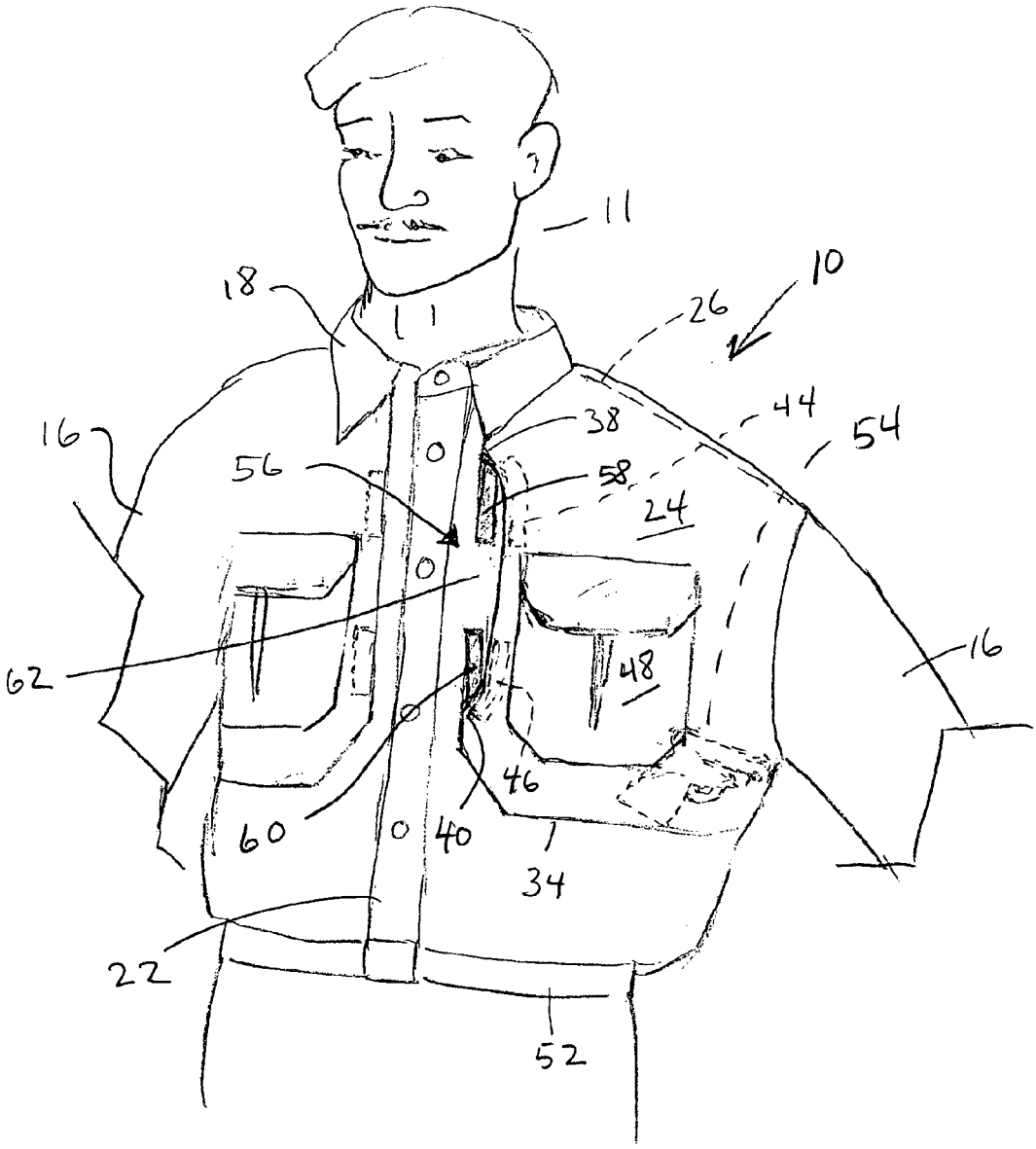
FIG. 2 is a perspective view somewhat similar to FIG. 1 and showing a concealed weapon carried in a hidden pocket of the shirt, the pocket shown in an opened position.
Figure 4:
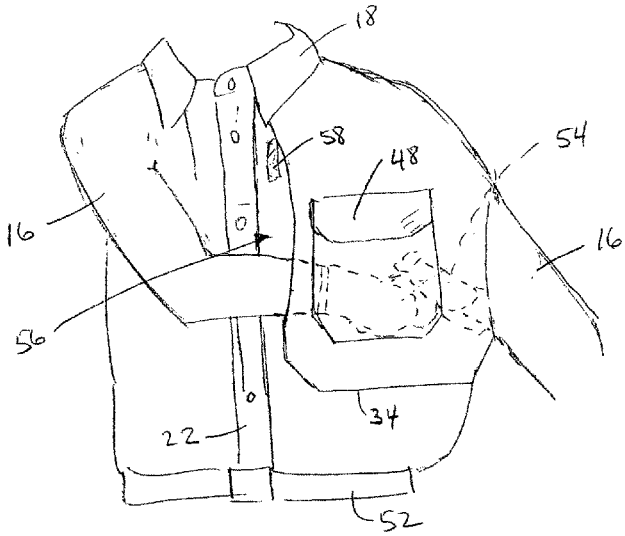
FIG. 4 is a frontal view showing a weaver of the tactical shirt retrieving a handgun from the pocket.

FIG. 2 shows the shirt 10 of FIG. 1 as worn tucked into a belt 52 of the wearer. A handgun is shown at 54 in dashed lines, carried within the hidden pocket and fully concealed. The handgun is carried generally below the armpit area, alongside the ribs in a comfortable position, generally where underarm holsters have typically been placed. The hidden pocket is shown in this view its opening 56 spread open, as would be the case when the user 11 reaches his hand into the pocket to retrieve the gun, which is schematically indicated in FIG. 4. In this view patches 58 and 60 of hook/loop fastener material are seen, disengaged from the mating hook/loop fastener patches 44 and 46 indicated in FIG. 1 and in dotted lines in FIG. 2. All of these strips or patches of hook/loop fastener are discrete patches, preferably located substantially at top and bottom of the opening 56. A space 62 extends vertically between the patches 58, 60, devoid of any fasteners. When the hook/look fasteners are engaged, the appearances of a continuous seam 36 such as shown in FIG. 1, since the fasteners hold the entire pocket closure of the panel of 24 flatly against the underlying fabric. This gap or space, as noted above, may be about 2 inches to 3 inches in height, preferably about 2½ inches, while each strip of hook/loop fasteners may be about 2 to 2½ inches. The total height of the pocket opening may be about 7 to 9 inches. As used herein, the term hook/loop fasteners is intended to refer generically to either the hook/loop material, the loop material or both.

Figure 3:
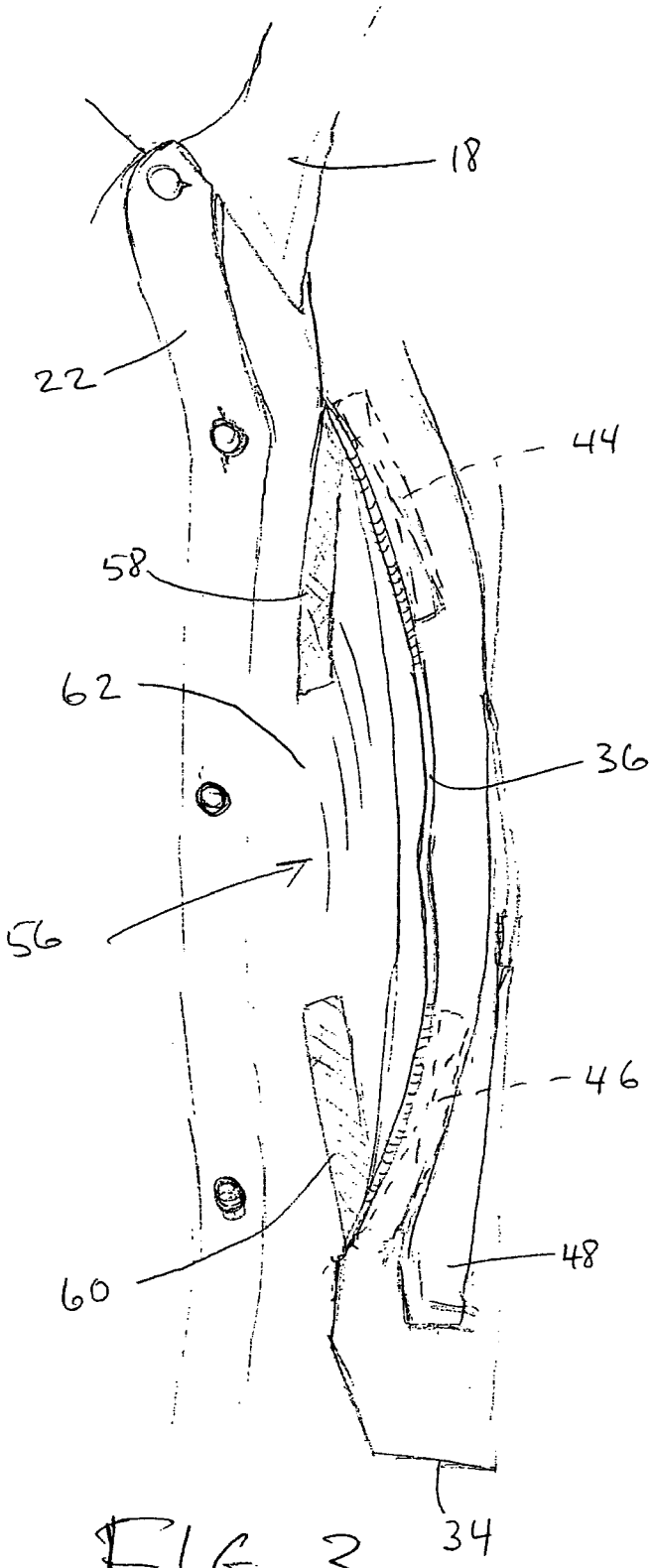
FIG. 3 is an angled elevation view showing the opening of the hidden pocket, in a configuration as if held open to retrieve a weapon.

FIG. 4 shows schematically the user retrieving 54 from the hidden pocket, again with the pockets bent open, and FIG. 3 shows a close up of the pocket seam in opened configuration. The pocket opening in 56 is of sufficient height that a user's hand can easily be inserted, and the gap or space 62 between the strips of hook/loop fastener material is large enough to receive several fingers of a hand from the opposite side (see FIG. 4), quickly inserted into this gap in a wedging fashion to spread the Velcro open to disengagement.

Although hook/loop fasteners are preferred for closure of the hidden pocket at the opening 56, other quick-release fastening means can be used. For example, a plurality of snaps could be used, although these are more time-consuming to close and Velcro is preferable. Strips of sheet magnet material could be employed for this purpose if desired.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

What is claimed is:

1. A tactical shirt for carrying a concealed weapon, comprising:

a fabric shell in the general shape of a shirt, having sleeves and having a central frontal shirt opening line with fasteners for closing the shirt at the opening line, a hidden pocket at least at one side of the shirt front, with a vertically oriented pocket opening near the shirt opening line, the hidden pocket being formed between the fabric shell of the shirt and an outer piece of fabric material overlying the fabric shell and secured to the fabric shell at seams, the seams including a top shoulder seam which is integral with a seam connecting front and back panels of the fabric shell, a side seam generally below the armpit area and extending generally vertically, a sleeve seam integral with a connection of a chest panel of the shell to a sleeve piece, a bottom seam, and a front seam along a pocket opening line of the hidden pocket which is substantially continuous in appearance down the length of the front seam including at the pocket opening and above and below the pocket opening, and a pocket closure comprising upper and lower hook/loop fastener patches substantially at upper and lower ends of the pocket opening, the hook/loop fastener patches being engageable to close the opening of the hidden pocket, and with a space devoid of fasteners and extending vertically between the upper and lower hook/loop fastener patches, such space being of a sufficient height to enable a user to insert at least two fingers to a wedge a hand into the pocket opening to release engagement of the hook/loop fastener patches, whereby a handgun or other concealed weapon can be placed inside the hidden pocket and can comfortably be stored generally below the user's armpit alongside the rib cage, and whereby, when the weapon is to be retrieved, the user can reach into the unfastened space of the pocket opening line, to force the hook/loop fasteners to disengage and to retrieve the weapon efficiently.

2. The tactical shirt as described in claim 1, wherein the fasteners closing the shirt at the central frontal shirt opening line comprise buttons.

3. The tactical shirt as described in claim 1, wherein the bottom seam of the pocket is located generally at a location of the bottom of a wearer's ribs.

4. The tactical shirt as described in claim 1, wherein the fabric of the shirt is woven.

5. The tactical shirt as described in claim 1, wherein the fabric of the shirt has a weight of at least five ounces per square yard.

6. The tactical shirt as described in claim 5, wherein the shirt fabric has a weight of at least 5.5 ounces per square yard.

7. The tactical shirt as described in claim 5, wherein the shirt fabric has a weight in the range of about 5.8 to 6.5 ounces per square yard.

8. The tactical shirt as described in claim 1, wherein the shirt has a button front, with a placket extending vertically and the buttons located in the placket, and wherein the pocket opening line for the hidden pocket is spaced away less than about one inch from an adjacent edge of the placket.

9. The tactical shirt as described in claim 1, wherein the shirt has a button front, with a placket extending vertically and the buttons located in the placket, and wherein the pocket opening line for the hidden pocket is spaced away about one half inch from an adjacent edge of the placket.

10. The tactical shirt as described in claim 1, wherein the seam along the pocket opening line of the hidden pocket comprises at least a doubled over strip of fabric, reinforced with stitching along the length of the pocket opening line, including above and below the pocket opening.

11. The tactical shirt as described in claim 1, further including a weapon carried in the hidden pocket, generally beneath the armpit area of the shirt.

12. The tactical shirt as described in claim 11, including at least about five pounds of items carried in the hidden pocket.

13. The tactical shirt as described in claim 1, with two said hidden pockets provided, one on each side of the shirt front.

14. The tactical shirt as described in claim 13, further including an exposed, visible pocket formed on the outside of said outer piece of fabric material, over both hidden pockets.

15. A tactical shirt for carrying a concealed weapon, comprising:

a fabric shell in the general shape of a shirt, having sleeves and having a central frontal shirt opening line with fasteners for closing the shirt at the opening line, a hidden pocket at least at one side of the shirt front, with a vertically oriented pocket opening near the shirt opening line, the hidden pocket being formed between the fabric shell of the shirt and an outer piece of fabric material overlying the fabric shell and secured to the fabric shell at seams, including a side seam generally below the armpit area and extending generally vertically, the hidden pocket extending to said side seam, and including a front seam along a pocket opening line of the hidden pocket which is substantially continuous in appearance down the length of the front seam including at the pocket opening and above and below the pocket opening, and a pocket closure including upper and lower quick-release fastener means substantially at upper and lower ends of the pocket opening, the quick-release fastener means being engageable thereby to close the opening of the hidden pocket, and with a space devoid of fastener means and extending vertically between the upper and lower quick-release fastener means, such space being of a sufficient height to enable a user to insert at least two fingers to wedge a hand into the pocket opening to release engagement of the quick-release fastener means, whereby a handgun or other concealed weapon can be placed inside the hidden pocket and can comfortably be stored generally below the user's armpit alongside the rib cage, and whereby, when the weapon is to be retrieved, the user can reach into the unfastened space to force the quick-release fastener means to disengage and to retrieve the weapon efficiently.

16. The tactical shirt as described in claim 15, wherein the fasteners closing the shirt at the central frontal shirt opening line comprise buttons.

17. The tactical shirt as described in claim 15, wherein the bottom seam of the pocket is located generally at a location of the bottom of a wearer's ribs.

18. The tactical shirt as described in claim 15, wherein the fabric of the shirt is woven.

19. The tactical shirt as described in claim 15, wherein the fabric of the shirt has a weight of at least five ounces per square yard.

20. The tactical shirt as described in claim 19, wherein the shirt fabric has a weight of at least 5.5 ounces per square yard.

21. The tactical shirt as described in claim 19, wherein the shirt fabric has a weight in the range of about 5.8 to 6.5 ounces per square yard.

22. The tactical shirt as described in claim 15, wherein the shirt has a button front, with a placket extending vertically and the buttons located in the placket, and wherein the pocket opening line for the hidden pocket is spaced away less than about one inch from an adjacent edge of the placket.

23. The tactical shirt as described in claim 15, wherein the shirt has a button front, with a placket extending vertically and the buttons located in the placket, and wherein the pocket opening line for the hidden pocket is spaced away about one half inch from an adjacent edge of the placket.

24. The tactical shirt as described in claim 15, wherein the seam along the pocket opening line of the hidden pocket comprises at least a doubled over strip of fabric, reinforced with stitching along the length of the pocket opening line, including above and below the pocket opening.

25. The tactical shirt as described in claim 15, further including a weapon carried in the hidden pocket, generally beneath the armpit area of the shirt.

26. The tactical shirt as described in claim 25, including at least about five pounds of items carried in the hidden pocket.

27. The tactical shirt as described in claim 15, with two said hidden pockets provided, one on each side of the shirt front.

28. The tactical shirt as described in claim 27, further including an exposed, visible pocket formed on the outside of said outer piece of fabric material, over both hidden pockets.

* * * * *